United States Patent [19]

Voith

[11] Patent Number: 5,010,950

[45] Date of Patent: Apr. 30, 1991

[54] BALL STRAINER FOR CIRCULATING BALL CLEANING SYSTEM

[75] Inventor: Donald J. Voith, Milwaukee, Wis.

[73] Assignee: Water Services of America, Inc., Milwaukee, Wis.

[21] Appl. No.: 406,779

[22] Filed: Sep. 13, 1989

[51] Int. Cl.[5] ..... F28G 1/12; B08B 9/04

[52] U.S. Cl. ..... 165/95; 165/5; 15/3.51

[58] Field of Search ..... 165/95, 5; 15/3.51

[56] References Cited

U.S. PATENT DOCUMENTS

| | | | |
|---|---|---|---|
| 4,135,574 | 1/1979 | Treplin et al. | 165/95 |
| 4,304,295 | 12/1981 | Otake | 165/95 |
| 4,314,604 | 2/1982 | Koller | 165/95 |
| 4,350,202 | 9/1982 | Schulz et al. | 165/95 |
| 4,385,660 | 5/1983 | Koller | 165/95 |
| 4,523,634 | 6/1985 | Bizard | 165/95 |

FOREIGN PATENT DOCUMENTS

| | | | |
|---|---|---|---|
| 3216443 | 11/1983 | Fed. Rep. of Germany | 165/95 |
| 1320643 | 6/1987 | U.S.S.R. | 165/95 |
| 2066920 | 7/1981 | United Kingdom | 15/3.51 |

*Primary Examiner*—John Rivell
*Assistant Examiner*—L. R. Leo
*Attorney, Agent, or Firm*—Andrus, Sceales, Starke & Sawall

[57] ABSTRACT

A ball strainer for foam rubber cleaning balls in a cleaning system for process piping includes a ball collecting and discharge chamber at the downstream end of the screen which is disposed wholly outside the wall of the pipe in which the screen is mounted. The chamber is dimensioned and oriented to completely eliminate the pinch point between the screen and the pipe wall. Mounting the collecting chamber on the outside of the pipe wall allows the use of a planar screen with a smooth elliptical edge which is of substantially simpler construction and offers a minimum resistance to cooling water flow.

6 Claims, 2 Drawing Sheets

BALL STRAINER FOR CIRCULATING BALL CLEANING SYSTEM

BACKGROUND OF THE INVENTION

The present invention pertains to a system utilizing circulating foam rubber balls as a cleaning media and, more particularly, to a ball straining mechanism for a circulating ball cleaning system used for cleaning the tubes in a heat exchanger.

It is well known in the art to provide the condenser in a heat exchanger with a large number of parallel tubes through which cooling water is directed. The condenser tubes are supplied with cooling water by a pump-operated recirculating system, typically receiving water from a cooling tower, circulating it through the heat exchanger condenser and returning it to the cooling tower.

Various methods are utilized for periodically cleaning the condenser tubes to remove deposits which accumulate therein. Typically, the condenser tubes may be about 1" in diameter and, in one known method, resilient foam rubber balls having a diameter slightly larger than the tubes are circulated therethrough with the cooling water. The balls are compressed slightly as they enter the tubes and are forced through the tubes by water pressure carrying accumulated deposits with them. The balls are injected into the cooling water flow from a parallel branch upstream from the condenser and are removed from the stream after they exit the condenser and diverted from the main cooling water flow back into the parallel branch for recirculation or collection. To separate the balls from the return flow to the cooling tower, a ball strainer comprising a large screen is disposed in the return flow piping system where the balls are screened from the flow and diverted into the collection/recirculation branch.

Ball strainers typically comprise an elongated screen section which is disposed at an angle in the main cooling water piping system. The downstream edge of the screen is elliptically shaped to closely fit the interior contour of the pipe when the screen is disposed at an acute angle to the pipe axis. Balls accumulating on the screen are funneled by the cooling water flow to the narrow downstream end where the apex of the elliptical screen meets the pipe wall. Here the balls accumulate and are diverted through a small opening in the wall of the pipe and directly into the small diameter collection/recirculation branch pipe. Thus, the primary flow of cooling water continues through the main piping system and a relatively small volume of cooling water is diverted with and carries the balls through the branch pipe, with the flow therethrough induced by a separate pump in the branch line.

Because of the shape and orientation of an elliptical ball strainer, it inherently creates a pinch point where its downstream apex meets the pipe wall. Special means are required to prevent balls from being trapped at the pinch point and accumulating such that they cannot be properly diverted and removed from the system. One prior art device comprises a collecting cup formed in the downstream end of the screen generally at the apex of the ellipse. The cup has a side wall which extends radially inwardly of the pipe to eliminate the pinch point at the ball diversion outlet. However, this construction requires the smooth planar elliptical surface of the screen to be interrupted and substantially complicates the manufacture of the screen and, therefore, the cost. Another prior art device utilizes an elliptical flange on the downstream portion of the screen, which flange is disposed generally perpendicular to the plane of the screen such that the edge of the lip engages the pipe to maintain the planar screen offset from the pipe wall. This also eliminates the sharp pinch point at the apex of the ellipse to prevent the jamming and accumulation of cleaning balls which might plug the ball diversion opening. Ball strainer screens are pivotally mounted inside the pipe such that they maybe rotated between a screening and a backwash position, the latter occurring after the balls have been completely diverted and temporarily collected in the branch line. However, the attachment of the large perpendicular lip to the downstream edge of the screen adds very substantially to the resistance to flow across the screen, making it difficult and requiring added power to rotate the screen between its backwash to its straining position. U.S. Pat. No. 4,385,660 is typical of prior art screening and diverting apparatus.

SUMMARY OF THE INVENTION

In accordance with the present invention, the problems presented by prior art elliptical screens used in a ball strainer are eliminated by providing a ball collecting and discharge chamber in the wall of the tubular pipe section at the ball collecting and discharge point. The chamber is constructed and located to completely eliminate the pinch point and to lie completely out of the primary cooling water flow path. In addition, it does not require any modification to the flat planar construction of the elliptical screen.

The chamber is located at the ball collecting and discharge area where the downstream apex of the screen meets the wall of the tubular pipe section within which it is mounted. The chamber includes an enlarged inlet opening in the interior surface of the pipe wall and a smaller outlet opening radially outwardly of the pipe from the inlet opening. The collecting and discharge chamber includes a convergent peripheral chamber wall extending between the inlet opening and the smaller outlet opening. Preferably, the chamber wall defines a circular inlet subchamber which tapers to an integral outlet sleeve defining the outlet opening.

The apparatus of the present invention may be utilized with a prior art baffle plate to redirect fluid flow in the collecting and discharge area for enhanced ball collection. The simple fully planar elliptical screen which may be utilized with the ball collecting and discharge chamber of the present invention may be pivotally attached in a known manner to the interior wall of the pipe section for rotation between a screening position and a backwash position with a minimum expenditure of power.

DETAILED DESCRIPTION OF THE PREFERRED EMBODIMENT

Figure 1:
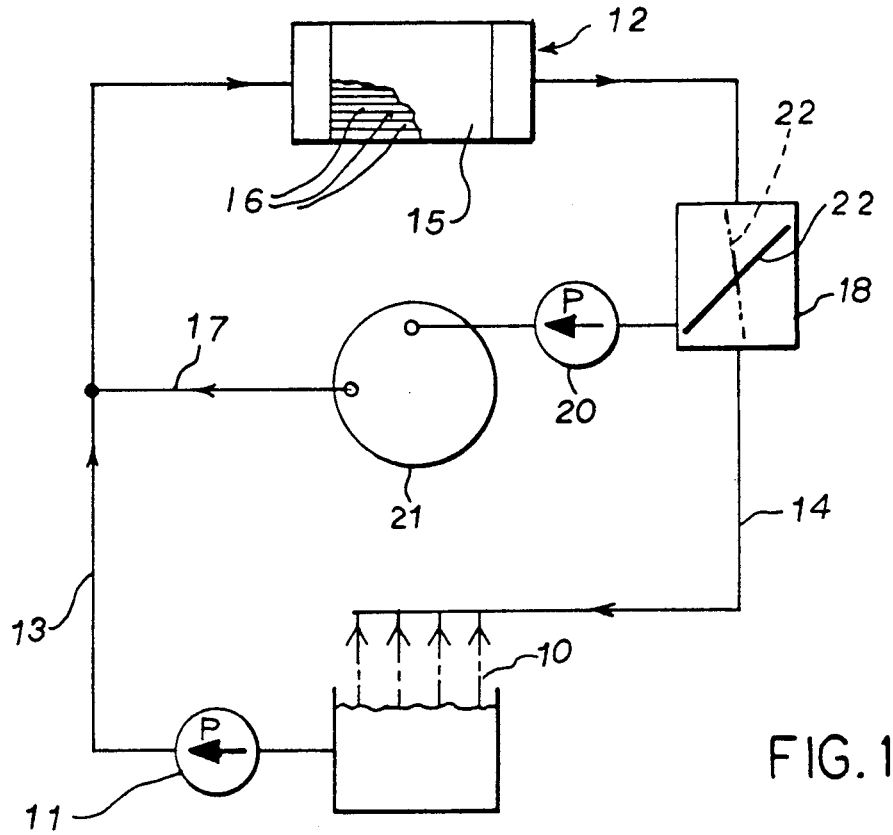
FIG. 1 is a schematic representation of a cooling water circulation and ball cleaning system for which the present invention is particularly adapted.

Referring initially to FIG. 1, a typical cooling water circulation system receives a supply of cooling water from a cooling tower 10 which is circulated by a pump 11 via a main supply pipe 13 through a heat exchanger 12 and back to the cooling tower via a main return pipe 14. The heat exchanger includes a condenser 15 comprising a large number of small tubes 16 through which the cooling water flows.

Periodically, the tubes 16 in the condenser must be cleaned of deposits which accumulate therein. In the system shown, a large number of foam rubber balls of a diameter slightly larger than the tubes 16 are circulated with the cooling water through the condenser where the balls randomly are forced by system pressure through the tubes where they strip deposits from the tube walls. The balls are confined to flow through the condenser by a parallel branch pipe 17 disposed between the main supply line 13 and the return line 14. Balls exiting the condenser 15 are taken out of the main cooling water flow by a ball strainer 18 which diverts the balls into the branch pipe 17 under the influence of a ball circulating pump 20. Branch pipe 17 is just large enough to easily accommodate the movement of the balls therethrough and, therefore, does not divert a significant volume of cooling water from the main return line 14. For example, the main cooling water lines may be several feet or larger in diameter. The condenser tubes 16 may be typically less than 1½" in diameter and the cleaning balls slightly larger in diameter. The ball recirculating branch pipe 17 may, correspondingly, range in size of 2½" to 3". The foregoing sizes are merely exemplary and all of them may vary substantially.

The cleaning balls are not continuously circulated through the heat exchanger and, therefore, provision must be made to periodically collect the balls which are initially removed from the main line by the ball strainer 18. A ball collector 21 is disposed in the branch pipe line 17 and, in a fully open position, simply allows the cleaning balls to pass straight through for recirculation. The ball collector 21 also typically includes a collecting position in which an internal collecting screen is oriented to strain the balls from the circulating water flow through the branch pipe 17. The balls are typically collected and held such that the screen 22 in the ball strainer 18 may be rotated from its full line ball straining position in FIG. 1 to the dotted line backwash position such that the cooling water flow through the strainer will clean the screen of accumulated debris and the like. The ball collector 21 also typically includes a ball removal position, such that cleaning balls which have become worn to the point that they are undersized or otherwise ineffective can be removed from the system and replaced.

Figure 4:
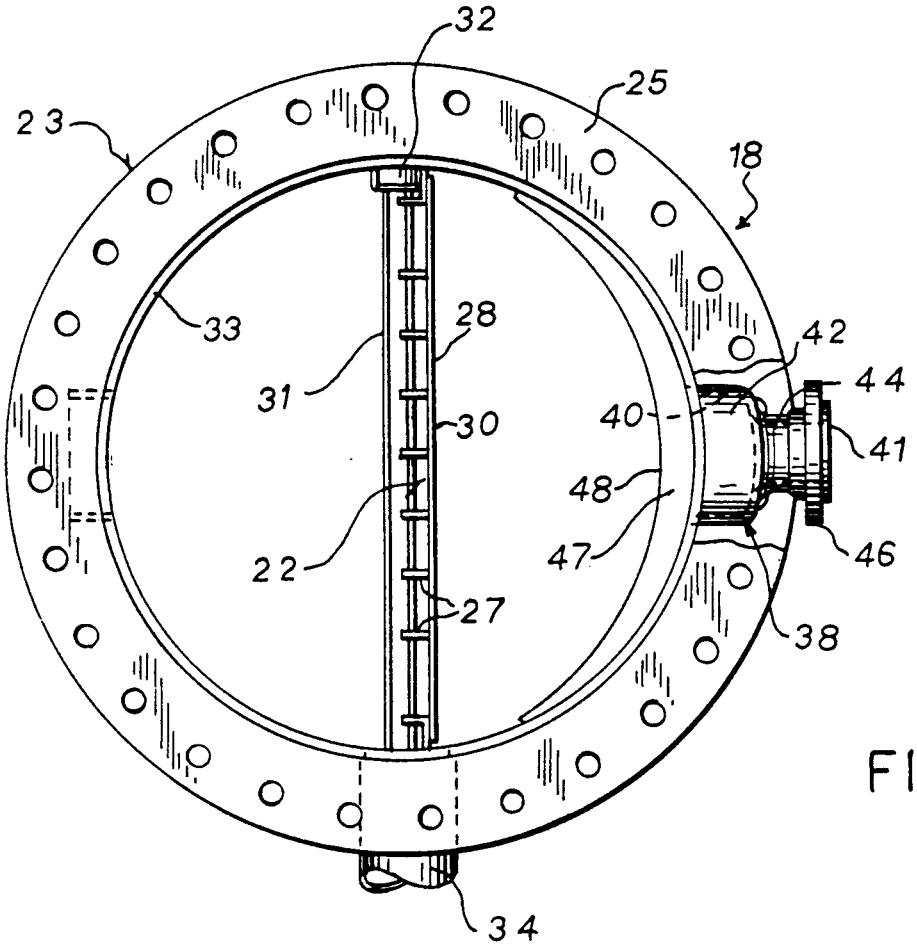
FIG. 4 is an axial end view, partly in section, of the ball strainer looking upstream.
Figure 2:
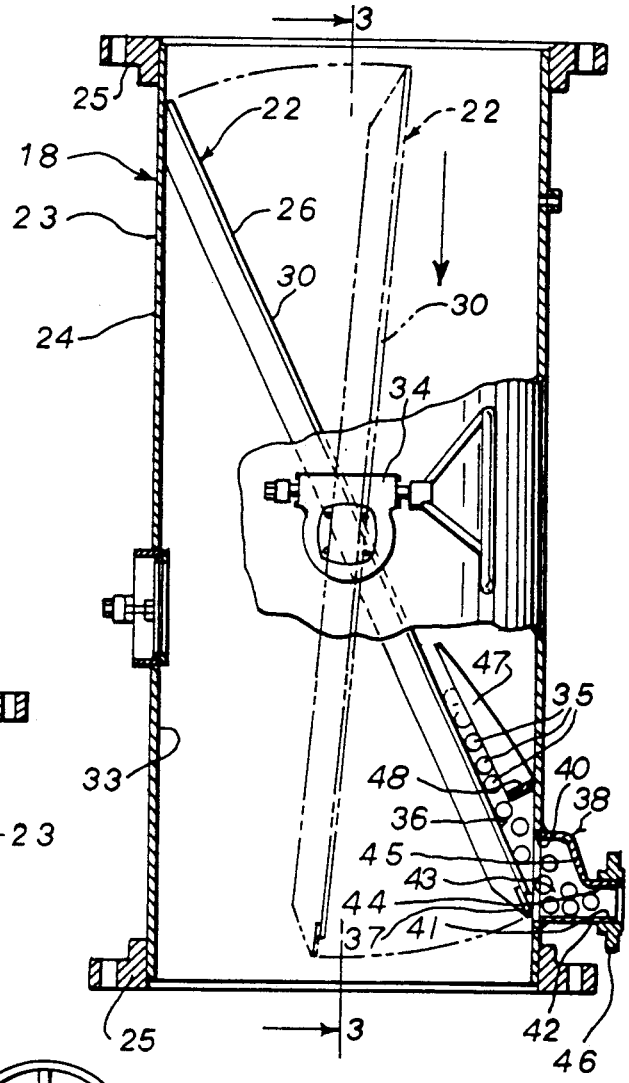
FIG. 2 is an enlarged side elevation of a ball strainer, partly in section and taken on a plane perpendicular to the screen, showing the ball collecting and discharge chamber of the present invention.
Figure 3:
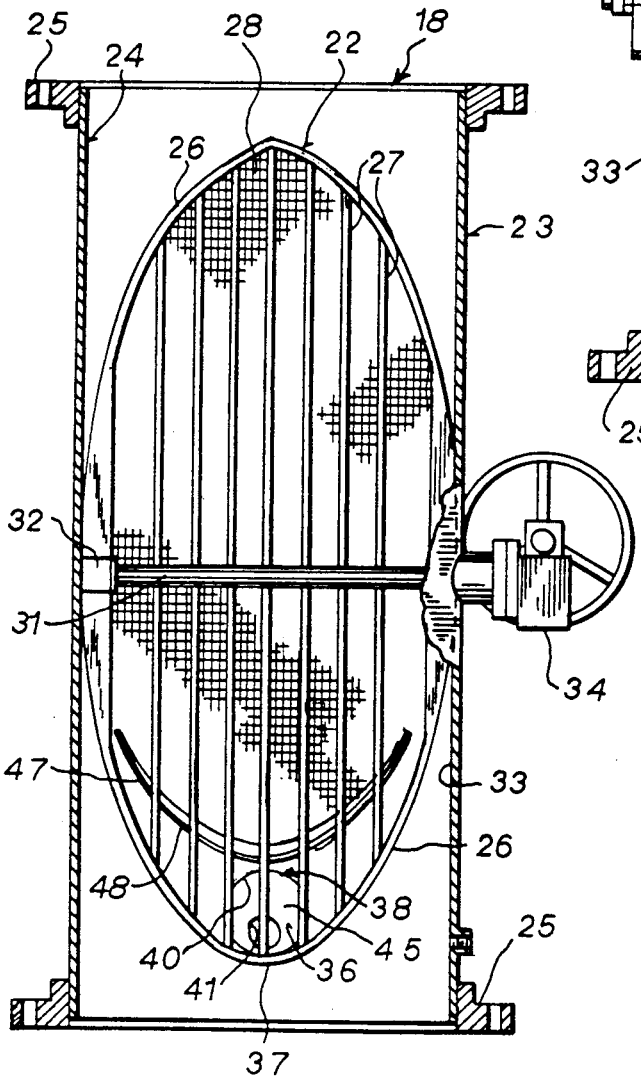
FIG. 3 is a sectional side elevation taken on line 3—3 of FIG. 2.

Referring also to FIGS. 2–4, the ball strainer 18 comprises a strainer housing 23 which, most typically, is a short cylindrical pipe section 24 of the same diameter as the main return pipe 14. The pipe section 24 is provided with end flanges 25 for attachment to similar flanged ends (not shown) at the break in the return pipe 14 in which the housing is mounted. As may best be seen in FIG. 3, the screen 22 is generally elliptical and has a minor axis approximately equal to the diameter of the pipe section 24. The screen is disposed with its major axis extending generally along the axis of the pipe such that the plane of the screen lies at an acute angle to the pipe wall.

The screen 22 includes an elliptical edge 26 within which are disposed a series of spaced parallel bars 27 covered by a heavy wide mesh screen member 28 to provide a smooth planar upstream surface 30 in the full line position shown in FIG. 2. The screening bars 27 are oriented parallel to the direction of flow to provide a minimum resistance and, along with the other mounting attachments (to be described), are disposed on the downstream face to retain the relatively smooth planar upstream surface 30.

The screen 22 is mounted for limited rotation within the housing 23 on a shaft 31, one end of which is supported on a bearing mount 32 in the pipe wall and the other end of which extends through the pipe section wall 33 diametrically opposite the bearing mount 32 for attachment to a manual and/or motor-operated actuator 34. The actuator is operable to rotate the screen 22 through a limited arc from its screening position in FIG. 2 to a backwash position (shown in dashed lines) whereby the cooling water removes accumulated debris and the like from the upstream surface 30.

As may be seen by reference to both FIG. 2 and FIG. 3, the cleaning balls 35 are moved into the strainer housing 23 under the influence of the cooling water flow and travel along the upstream surface 30 of the screen 22 such that they converge in a narrow ball collecting and discharge area 36 defined by the downstream apex 37 of the elliptical screen and the adjacent portion of the pipe wall 33. All prior art ball collection devices utilize an opening in the pipe wall 33 in the collecting and discharge area 36 through which the balls 35 are diverted for collection or recirculation in the ball collector 21. The prior art devices intended to eliminate the pinch point at the screen apex 37 have been previously described. It should also be noted that some prior art devices utilize a two-piece screen divided along the axis of the minor diameter of the ellipse, such that two screen half sections extend downstream with their respective apexes in contact with diametrically opposite points on the pipe wall.

The present invention comprises a ball collecting and discharge chamber 38 in the pipe section wall 33 and extending radially outwardly therefrom. The chamber 38 is located just upstream of the screen apex 37 and generally centered on the major axis thereof. The chamber 38 includes a large circular inlet opening 40 defined by a circular hole in the pipe wall 33 and a smaller circular outlet opening 41 in the radially outward end of the chamber. The chamber wall 42 may be constructed in any convenient shape which converges from the inlet opening 40 to the outlet opening 41 to funnel the balls into the branch pipe 17. In the embodiment shown, the chamber wall 42 defines a cylindrical inlet subchamber 43 and an integral outlet sleeve 44 connected by an intermediate sloping wall portion 45. The subchamber 43 is located with the downstream edge of its wall immediately adjacent the apex 37 of the elliptical screen edge 26. In this manner, the pinch point between the upstream screen surface 30 and the pipe wall 33 is completely eliminated, but without any obstruction in the direct path of cooling water flow and without interrupting the smooth elliptical contour of the screen edge.

The end of the outlet sleeve 44 may be provided with a connecting flange 46 for attachment to the branch pipe 17 in a conventional manner. A baffle 47 of a type similar to that known in the prior art may be attached to the interior surface of the wall upstream from the inlet opening 40 to the chamber 38. The baffle 47 comprises an upstanding lip 48 in the shape of a partial ellipse mounted to slant in a downstream direction. Cooling water flow over the lip 48 creates a turbulence at the collecting and discharge area 36 which helps sweep the cleaning balls 35 into the chamber 38. The edge of the lip 48 at its apex is spaced from the screen surface 30 by an amount sufficient to allow the balls to pass freely thereover without obstruction.

Various modes of carrying out the present invention are contemplated as being within the scope of the following claims particularly pointing out and distinctly claiming the subject matter which is regarded as the invention:

I claim:

1. In a circulating ball cleaning system for a fluid-carrying process piping arrangement, including a tubular ball straining section having a generally smooth cylindrical interior wall having an elliptical screen mounted in a screening position therein said screen having a regular elliptical edge in continuous engagement with the section wall and the screen surface disposed at an acute angle to the section wall to provide a narrow downstream collecting and discharge area, the improvement comprising:

a ball collecting and discharge chamber in the wall of the tubular section at the collecting and discharge area, said chamber lying entirely outside the cylindrical interior wall, said chamber having an enlarged inlet opening in the interior surface of the section wall defining an enlarged cylindrical subchamber and a smaller outlet opening radially outwardly of said inlet opening, whereby continuous engagement between the edge of the elliptical screen and the cylindrical interior wall in the screening position is maintained.

2. The apparatus as set forth in claim 1 wherein said chamber comprises a peripheral chamber wall which converges from said inlet opening to said outlet opening.

3. The apparatus as set forth in claim 2 wherein said chamber wall defines a cylindrical inlet subchamber adjacent said inlet opening and an integral outlet sleeve adjacent said outlet opening.

4. The apparatus as set forth in claim 1 including a baffle plate means attached to the interior surface of the section wall upstream of said chamber for redirecting fluid flow in the collecting and discharge area.

5. The apparatus as set forth in claim 1 wherein said screen is pivotally attached to the interior wall of the tubular section for rotation between said screening position and a backwash position.

6. In a system for circulating foam rubber cleaning balls through the condenser tubes of a heat exchanger, an improved ball straining apparatus comprising:

a strainer housing defined by a pipe section having a cylindrical interior surface;

a ball screen mounted in the pipe section and having an elliptical edge;

screen members disposed within said elliptical edge and defining a generally planar upstream screen surface;

said screen disposed in a screening position at an acute angle to the axis of the pipe section such that the downstream apex of the elliptical screen edge defines a narrow downstream collecting and discharge area;

a ball collecting and discharge chamber formed in the pipe section wall entirely radially outwardly of the interior surface thereof;

said chamber having an inlet opening in the pipe wall, said opening having a downstream edge adjacent the apex of said screen edge and extending upstream therefrom;

said chamber having a chamber wall defining an enlarged cylindrical subchamber and an intermediate wall portion convergent radially outwardly to define an outlet opening smaller than said inlet opening; and, means for rotating said screen into said screening position wherein said elliptical edge of said screen including the apex thereof is in continuous engagement with said cylindrical interior surface.

* * * * *